US005230195A

United States Patent [19]

Sease

[11] Patent Number: 5,230,195

[45] Date of Patent: Jul. 27, 1993

[54] INSULATING MOLDED PLASTIC BUILDING UNIT

[76] Inventor: Stanley R. Sease, 14016 W. 48th Ter., Shawnee, Kans. 66216

[21] Appl. No.: 718,653

[22] Filed: Jun. 21, 1991

[51] Int. Cl.[5] ..... E04B 1/02; E04C 1/00

[52] U.S. Cl. ..... 52/593; 52/591; 52/309.9; 52/603

[58] Field of Search ..... 52/603 X, 309.9, 591, 52/592, 593, 594

[56] References Cited

U.S. PATENT DOCUMENTS

| | | | |
|---|---|---|---|
| 57,461 | 8/1866 | Bartlett et al. . | |
| 278,224 | 5/1883 | Crandall . | |
| 429,061 | 5/1890 | Reynhold . | |
| 711,541 | 10/1902 | Standau . | |
| 1,604,391 | 10/1926 | Croy . | |
| 1,689,107 | 10/1928 | Bradley . | |
| 1,971,545 | 8/1934 | Tompkins . | |
| 2,262,199 | 11/1941 | Paulson . | |
| 3,005,282 | 10/1961 | Christiansen . | |
| 3,116,570 | 1/1964 | Torricelli | 52/591 |
| 4,304,080 | 12/1981 | Freeman | 52/309.9 |

FOREIGN PATENT DOCUMENTS

| | | | |
|---|---|---|---|
| 606523 | 12/1934 | Fed. Rep. of Germany | 52/603 |

*Primary Examiner*—Carl D. Friedman
*Assistant Examiner*—Wynn E. Wood
*Attorney, Agent, or Firm*—Litman, McMahon & Brown

[57] ABSTRACT

An insulating molded plastic building unit comprises a rectangular parallelopiped without a rear wall. One or more alignment bosses extending upwardly and outwardly from an upper wall of the building unit are equidistantly spaced from a front face and a side face thereof to cooperatively align with alignment sockets of and automatically space superimposed building units. Each building unit has vertical and diagonal webs for structural reinforcement thereof. Cavities within each building unit can be filled with insulating material to enhance the insulating characteristics thereof. A plurality of the building units are laid in courses with joints formed therebetween with waterproof adhesive.

12 Claims, 1 Drawing Sheet

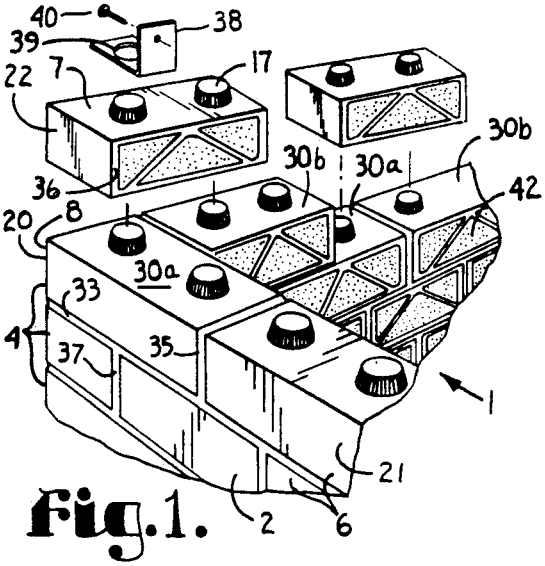
Fig.1.
Fig.4.
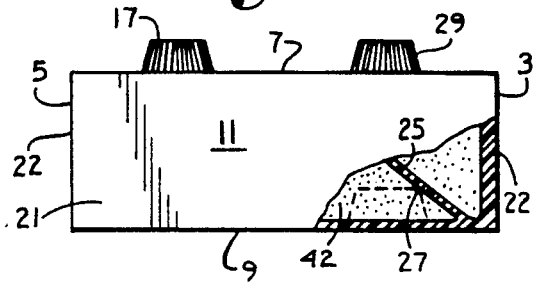
Fig.3.
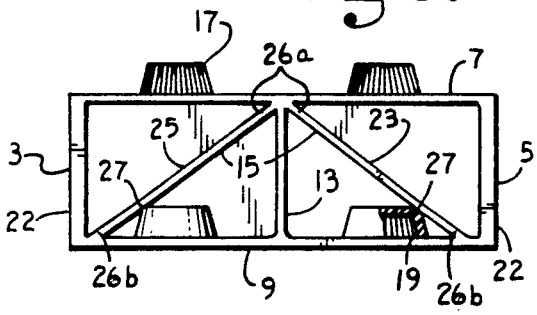
Fig.2.
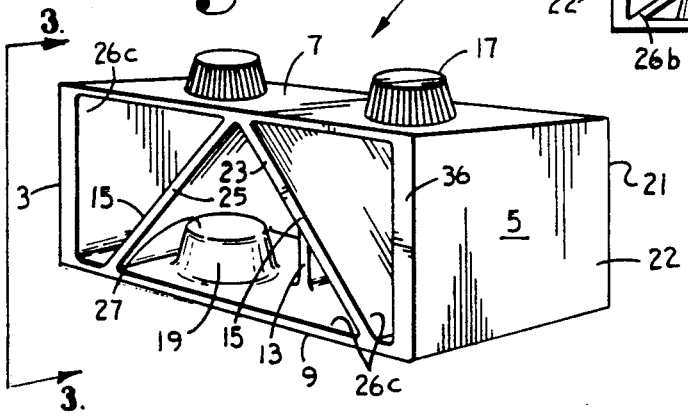
Fig.5.
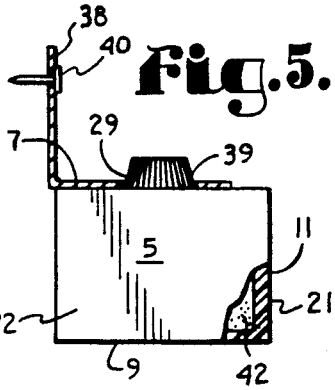
Fig.6.
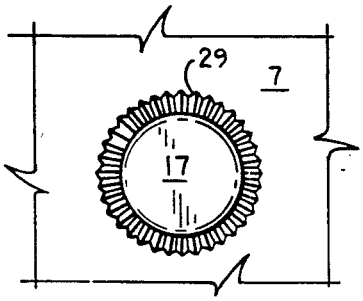
Fig.7.
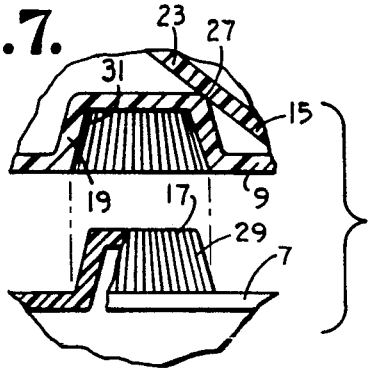

INSULATING MOLDED PLASTIC BUILDING UNIT

BACKGROUND OF THE INVENTION

The present invention relates to building units for exterior walls and, particularly, to lightweight, insulating building units.

Installation and material costs for masonry bricks and blocks for exterior applications continue to steadily increase. As a result, much of the population can no longer afford the attributes of masonry materials for such applications and generally has to settle for non-masonry substitutes. Although various panel type innovations have been developed to simulate masonry construction, even an untrained observer can easily detect the true nature of such substitutes.

Manufacturing methods using injection molding techniques are available which could produce individual building units which would be substantially more cost-effective as compared to the costs of conventional masonry products. Such a material would preferably be strong, lightweight, fire-retardant, non-toxic, inexpensive, impervious to moisture penetration, and not affected by sunlight or inclement weather conditions. Polyvinylchloride, and particularly PVC 7042, is particularly adapted to provide these characteristics.

Further, structures which are constructed with conventional masonry units may need to be periodically treated to prevent moisture penetration both through the masonry units themselves and through the mortar joints separating the masonry units. Building units constructed of polyvinylchloride could be cemented and bonded together with a resilient waterproof sealant, such as silicone caulking, thereby forming a waterproof and airproof joint between building units to supplement the waterproof and airproof barrier also provided by the building units themselves. In addition, such joints between the building units would provide the resiliency and flexibility needed to Withstand normal structural shifting and movement which causes cracking and separation in conventional masonry walls. Another benefit would be the elimination of having to properly combine ingredients for, mix and promptly use conventional mortar.

Also, considerable skill is generally required to properly position each masonry unit relative to adjoining and underlying masonry units in order to obtain acceptable, plumb workmanship. Alignment elements formed integrally in the building units could be utilized to automatically space and align each building unit being installed relative to those building units already installed. As a result, do-it-yourselfers could easily install such units, whereby additional cost effectiveness is realizable by eliminating expensive, highly skilled labor.

Conventional masonry units provide some insulating properties but such characteristics sometimes arise more from the heat energy stored in the bulk of the conventional masonry units rather than from dead-air space therein and low heat conductivity characteristics thereof. As a result, the insulating factor realized with conventional masonry units generally leaves much to be desired.

What is needed is a building unit which does not require considerable skill to properly align with adjoining and underlying units, which is lightweight, which has excellent insulating characteristics, and which is substantially impervious to moisture thereby eliminating the need for periodic weatherproofing treatments.

SUMMARY OF THE INVENTION

An insulating molded plastic building unit is provided which, in plurality, can be installed coplanarly to construct an exterior or interior wall of a structure. The building unit generally comprises a rectangular parallelopiped without a rear wall.

Each of the building units has one or more, preferably a pair, of alignment bosses extending upwardly and outwardly from a top wall thereof and a corresponding one or more, preferably a pair, of alignment sockets extending upwardly and inwardly from a bottom wall thereof. Each of the alignment bosses and the alignment sockets is generally equidistantly spaced from the outer face of the front wall and the outer face of one of the end walls such that each of the building units can be used either in a straight run along a course or at a corner of the wall being constructed with the building units.

The alignment bosses and the alignment sockets automatically align each of the building units being installed relative to underlying and horizontally adjacent ones of the building units already installed such that the need for highly skilled labor to obtain superior craftsmanship is largely eliminated.

Each of the building units includes a vertical web to reinforce the vertical structural strength thereof and one or more diagonal webs to reinforce the ability of the building units to resist skewing and thereby avoid fracturing of the corners thereof. The diagonal webs also divide the cavities within each of the building units into a cellular-type structure.

In the event that the length of one or more of the building units must be altered to adjust the length of a run to satisfy a desired finished horizontal wall dimension, an upper extremity of one of the alignment sockets is spaced in close proximity to a corresponding one of the diagonal webs such that the latter, if severed from the bottom wall of the building unit, will be supported by the former.

The building units are installed with waterproof joints therebetween to prevent moisture penetration. If greater insulating characteristics are desired, foam insulation may be injected into the cavities within each of the building units either before installation or afterward as dictated by accessibility thereto.

OBJECTS AND ADVANTAGES OF THE INVENTION

Therefore, the objects of the present invention are: to provide a building unit for exterior or interior application; to provide such a building unit which is lightweight; to provide such a building unit which, together with abutting building units, provides a wall and joints which are substantially impervious to moisture and air penetration; to provide such a building unit which has excellent insulating characteristics; to provide such a building unit which is essentially self-aligning with other adjoining units; to provide such a building unit, which does not require a high degree of skill to install; to provide such a building unit which requires relatively little maintenance; to provide such a building unit which is fire retardant; to provide such a building unit which resists degradation by sunlight and inclement weather; to provide such a unit which provides a wall which can flex with normal structural shifting and movements without cracking and separation; and to generally provide such a building unit which is inexpensive to manufacture and install, easy to maintain and which generally performs the requirements of its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of several courses of insulating molded plastic building units, in accordance With the present invention.

FIG. 2 is an enlarged and perspective rear view of the molded plastic building unit without insulating fill material therein.

FIG. 3 is an enlarged, rear elevational view of the molded plastic building unit without insulating fill material, taken along line 3—3 of FIG. 2, with a portion cut away to reveal details thereof.

FIG. 4 is an enlarged, front elevational view of the molded plastic building unit with insulating fill material therein, with a portion cut away to reveal details thereof. FIG. 5 is an enlarged, end elevational view of the molded plastic building unit, with a portion cut away to reveal details thereof.

FIG. 6 is an enlarged and fragmentary, top plan view of an alignment boss of the molded plastic building unit.

FIG. 7 is an enlarged and fragmentary, exploded view of the alignment boss of one of the molded plastic building units, with a portion cut away to reveal details thereof, and an alignment socket, in cross-section, of an adjoining one of the molded plastic building units, in accordance with the present invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to an insulating molded plastic building unit in accordance with the present invention, as shown in FIGS. 1–7. A plurality of the building units 1 are generally installed in several courses 4 to form a structural wall 2, including straight runs 6 and corners 8, as shown in FIG. 1.

Each of the building units 1 is generally in the form of a rectangular parallelopiped and includes a pair of opposing end walls 3 and 5; a top wall 7 connecting the upper extremities of the end walls 3 and 5; a bottom wall 9 connecting the lower extremities of the end walls 3 and 5; a front wall 11 connecting the forward extremities of the end walls 3 and 5, the top wall 7, and the bottom wall 9; structural reinforcing means, such as a vertical web 13 and a diagonal web 15; and alignment means, such as at least one alignment boss 17 in conjunction with at least one corresponding alignment socket 19. It is foreseen that the building units 1 can have other shapes, such as triangular, hexagonal, rhomboidal, etc., and yet cooperatively form a substantially coplanar wall.

Each of the building units 1 is integrally constructed of high impact plastic, such as polyvinylchloride or other suitable material, by injection molding, or other suitable means. The end walls 3 and 5 preferably have a greater thickness than that of the top wall 7 and the bottom wall 9 to facilitate the reliable formation of a waterproof joint between one of the building units 1 having an exteriorally exposed front wall 11 which is installed adjacent to another one of the building units 1 having an exteriorally exposed end wall, 3 or 5, such as near a corner 20 of the wall 2, as hereinafter described.

Preferably, the front wall 11 similarly has a greater thickness, as shown in FIG. 5, for those situations where a reliable waterproof seal must be formed between one of the building units 1 and a portion of another one of the building units 1, which has been altered in length along its horizontal dimension as hereinafter described.

As illustrated in the drawings, the dimensions of the front wall 11 are similar to the nominal dimensions of a standard masonry brick, so that the wall 2 constructed of the building units 1 will simulate the appearance of a masonry wall. However, it is to be understood that the building units 1 used for a particular project can have any other suitable horizontal and vertical dimensions as desired. In addition, the exposed faces, such as an outer face 21 of the front wall 11 and outer faces 22 of the end walls 3 and 5, can either be planar, as illustrated, or can assume a multitude of other profiles or textures, such as stone, geometrical figures, architectural designs, and the like.

Also, the materials used for forming the building units 1 may be tinted to assume any desired uniform color or color pattern—such as mottled, swirled, or the like—or may be subsequently cosmetically treated, such as by adhesively securing aggregate, or the like, to the exposed surfaces 21 and 22.

The vertical web 13 is generally perpendicular and integrally connected to the top wall 7, the bottom wall 9, and the front wall 11. The vertical web 13 generally extends rearwardly from the front wall 11 approximately one-half the width of the top wall 7.

The diagonal web 15 is generally comprised of a first portion 23 and a second portion 25 with both the first portion 23 and the second portion 25 perpendicular and integrally connected to the front wall 11. The rearmost extremities of the first portion 23 and the rearmost extremities second portion 25 are generally approximately flush with the rearmost extremities of the end walls 3 and 5, the top wall 7, and the bottom wall 9.

The uppermost extremities **26*a* of the first portion 23 and the second portion 25 are generally integrally connected to the top wall 7 near the mid-point thereof and to the vertical web 13, as shown in FIG. 3. The first portion 23 and the second portion 25 extend outwardly and downwardly such that their lowermost extremities 26*b* are generally integrally angularly connected to the bottom wall 9, as shown in FIG. 3. The first portion 23 and the second portion 25 divide the building unit 1 into a cellular-type structure or cavities 26*c*, as shown in FIG. 2**.

At least one, and preferably two, of the alignment bosses 17 are integrally formed in the top wall 7 such that the alignment bosses 17 extend upwardly and outwardly therefrom. Each of the alignment bosses 17 is equidistantly spaced from the outer face 21 of the front wall 11 and the outer face 22 of one of the end walls, 3 or 5. An equivalent number of the alignment sockets 19 are similarly integrally formed in the bottom wall 9 such that the alignment sockets 19 extend upwardly and inwardly into the building unit 1.

An upper extremity 27 of each of the alignment sockets 19 terminates in close proximity or, alternatively, is integrally connected, to a corresponding one of the diagonal webs 15 to provide additional structural support thereto.

Also, each of the alignment sockets 19 is generally equidistantly spaced from the outer face 21 of the front wall 11 and the outer face 22 of one of the end walls, 3 or 5, such that each of the alignment sockets 19 of one of the building units 1 is aligned with a different one of the alignment bosses 17 of that building unit 1.

An outer surface 29 of each one of the alignment bosses 17 is fluted, as shown in FIG. 6. Similarly, an inner surface 31 of each one of the alignment sockets 19 is fluted. The alignment bosses 17 and the alignment sockets 19, and the fluting thereof, are dimensioned and spaced such that one of the alignment sockets 19 can be slidably telescoped over a corresponding one of the alignment bosses 17, as shown in FIG. 7, such that there is minimal "play" therebetween. Alternatively, the surfaces 29 and 31 can be arcuate and unfluted, if desired, similar to a truncated cone. It is to be understood, however, that the sockets 19 can be elongated and have various dimensions relative to corresponding ones of the bosses 17, to allow for esthetic and structural variations in the relative vertical alignment of adjoining ones of the building units, as desired.

For those applications where each of the building units 1 has two of the alignment bosses 17 and two of the alignment sockets 19, one of the sockets 19 is telescoped over one of the alignment bosses 17 of one of the previously installed building units 1, such as that designated by the numeral 30*a*, and the other one of the sockets 19 is simultaneously telescoped over one of the alignment bosses 17 of an adjacent one of the building units 1, such as that designated by the numeral 30*b*. Thus, the building unit 1 being installed spans the joint between the two installed building units 1 having the two alignment bosses 17 being inserted therein, as shown in FIG. 1. As a result, the building unit 1 being installed is automatically and appropriately aligned, both vertically and horizontally, with the building units 1 previously installed such that minimal skill is required to obtain superior quality workmanship.

Since each of the alignment bosses 17 and the alignment sockets 19 are equidistantly spaced from the outer face 21 of the front wall 11 and the outer face 22 of one of the end walls 3 or 5, each of the building units 1 can be used either in a straight course run along the wall 2 or at the corner 20 thereof.

Preferably, the horizontal dimensions of the structure wall 2 appropriately correspond with the horizontal dimensions of the building units 1 such that whole ones of the building units 1 can be utilized. However, if it is necessary to alter or cut one or more of the building units 1 in each course to make the spacings properly correspond, then the close proximity of the appropriate alignment socket 19 to the corresponding diagonal web 15 is available to help support the diagonal web first portion 23 or second portion 25 which may no longer be connected to the bottom wall 9 by such alteration. When altering the length of one of the building units 1, it may also be necessary to remove one or more of the corresponding alignment bosses 17 from the adjoining building units 1.

Alternatively, the alignment sockets 19 may be replaced by appropriately spaced and dimensioned bores (not shown) through the bottom wall 9 such that those bores are slidably telescopable over the corresponding alignment bosses 17, with an upper extremity of each of the alignment bosses 17 then spaced in close proximity to a corresponding one of the diagonal webs 15.

In use, the building units 1 are generally laid in the courses 4, as shown in FIG. 1. As each of the building units 1 is installed, an adhesive comprised of waterproof material, such as silicone sealant or the like extruded from a caulking gun, is applied as one or more continuous horizontal beads or joints 33, and vertical beads or joints 35 to appropriate surfaces of the building unit 1 which abut surfaces of adjacently spaced ones of the building units 1 to cement and bond abutting ones of the building units 1 together. At least one of those beads or joints, 33 or 35, is spaced immediately adjacent to the outer faces 21 and 22 such that a waterproof and airproof barrier seal is formed between corresponding ones of the building units 1. The greater thickness of the end walls 3 and 5 provides a wider seat or base 36 for more reliable formation of a waterproof seal 37 between two of the building units 1 cooperating to form a portion of the corner 20 of the wall 2.

Support means, such as an anchor or hanger 38, in plurality, are connected to randomly selected ones of the building units 1, as shown in FIG. 5, to maintain vertical alignment of the wall 2 constructed of the building units 1 relative to an adjacent supporting wall (not shown). Each of the hangers 38 is constructed of steel, or other suitable material, and has a throughbore 39 which is dimensioned to slidably encircle one of the alignment bosses 17. The hanger 38 is sufficiently narrow such that it is contained within the joint 33 formed between an adjoining two of the building units 1. The hanger 38 is secured to such supporting wall by a nail 40, or other suitable device.

If enhanced insulating characteristics are desired for the building units 1, the cells or cavities 26*c* can be filled with an insulating material 42, such as foam insulation, or other suitable material. If the rear side of each of the building units 1 is accessible after installation such as when using the building units 1 to construct a veneer along an existing wall (not shown), then the insulating material 42 can be subsequently installed therein. However, if the rear side of the building units 1 is not accessible after installation, then the insulating material 42 can be installed in the building units 1 prior to installation thereof. Of course, if the enhanced insulating characteristics are not desired for a particular application, the building units 1 may be installed without filling the cavities 26*c* with insulating material 42 and thereby reduce cost of installation.

The building units 1 of the present invention can be used either for new construction or for remodeling and renovation. Due to their insulating characteristics, the building units 1 can be readily, exteriorally applied to existing structures to substantially reduce heat-loss through exterior walls.

It is to be understood that while certain forms of the present invention have been illustrated and described herein, it is not to be limited to the specific forms or arrangement of parts described and shown.

What is claimed and desired to be secured by Letters Patent is as follows:

1. A building unit comprising:
(a) a shell having walls including a front wall, a bottom wall, a top wall, and a pair of opposing end walls;
(b) at least one alignment boss formed integrally with and extending outwardly from said top wall;
(c) at least one alignment socket formed integrally with and extending inwardly from said bottom wall; said alignment socket dimensioned to be telescopable cover said alignment boss;
(d) vertical web means for strengthening said top wall and said bottom wall;
(e) diagonal web means for strengthening junctures between said pair of opposing end walls and said top wall and said bottom wall, respectively, said diagonal web means extending between said top and bottom wall;
(f) said alignment boss spaced equidistantly from an outer face of said front wall and from an outer face of one of said pair of opposing end walls; and
(g) said alignment socket is coaxial with the corresponding alignment boss.

2. The building unit according to claim 1 wherein:
(a) said diagonal web means divides said building unit into cellular cavities accessible from the rear of said building unit; and
(b) said cavities are fillable with insulating material.

3. The building unit according to claim 1 wherein:
(a) said alignment boss has a fluted outer surface; and
(b) said alignment socket has a fluted inner surface for receiving said fluted alignment boss.

4. The building unit according to claim 1 including:
(a) a pair of said alignment bosses; and
(b) a corresponding pair of said alignment sockets.

5. The building unit according to claim 1 wherein:
(a) said diagonal web means includes a first portion and a second portion; said first portion and said second portion perpendicular and integrally connected to said front wall; said first portion and said second portion integrally connected to said top wall near a mid-point thereof; said first portion and said second portion extending outwardly and downwardly with the lower extremities thereof integrally connected to said bottom wall near the outer extremities thereof.

6. The building unit according to claim 1 wherein:
(a) said alignment socket has an upper extremity spaced in close proximity to one of said diagonal web means to provide backup support therefor.

7. A wall assembly in side-by-side relationship with an underlying supporting structure, comprising:
(a) a plurality of building units, each including:
(1) a shell having:
(A) a top wall;
(B) a bottom wall;
(C) a front wall having a thickness greater than that of said top wall; and
(D) a pair of opposing end walls, each having a thickness greater than that of said top wall;
(2) alignment means for aligning one of said building units with other ones of said building units adjacent thereto, including:
(A) a pair of alignment bosses, each extending outwardly from said top wall; each of said bosses spaced equidistantly from an outer surface of said front wall and from an outer surface of one of said pair of opposing end walls; and
(B) a pair of alignment sockets, each extending inwardly from said bottom wall; each of said pair of alignment sockets dimensioned to slidably receive one of said pair of alignment bosses therein;
(3) structural reinforcing means for reinforcing each of said building units, including:
(A) a vertical web spaced approximately medially between said pair of opposing end walls; said vertical web connected to said top wall and said bottom wall; said vertical web connected to said front wall and extending rearwardly from said front wall approximately one-half of the width of said top wall; and
(B) a pair of diagonal webs, each having an upper end connected to said top wall and said vertical wall; each one of said pair of diagonal webs extending downwardly away from the other one of said pair of diagonal webs; each one of said pair of diagonal webs having a lower end connected to said bottom wall in close proximity to one of said pair of end walls such that respective said diagonal web is spaced in close proximity to one of said pair of alignment sockets;
(b) adhesive means for adhering each of said building units to adjacent ones of said building units such that a substantially waterproof pair is formed therebetween; and
(c) a plurality of hangers connected to selected ones of said building units and to the supporting structure.

8. A method for constructing a wall assembly in side-by-side relationship with an underlying supporting structure, comprising the steps of:
(a) providing a plurality of building units, each comprising:
(1) a shell having a top wall, a bottom wall, a front wall, and a pair of opposing end walls such that a cavity is formed therein;
(2) at least one alignment boss connected to an extending outwardly from said top wall said alignment boss being spaced equidistantly from an outer face of said front wall and from an outer face of one of said pair of opposing end walls;
(3) at least one alignment socket connected to and extending inwardly from said bottom wall such that said alignment socket cooperates with respective said alignment boss said alignment socket being coaxially with the corresponding alignment boss; and
(4) structural reinforcing web means connected to said top wall, said bottom wall, and said front wall such that said cavity is divided into a cellular structure;
(b) further providing an adhesive and a plurality of hangers, hangers having means for connecting to an alignment boss;
(c) placing said plurality of building units such that a staggered vertical array of said plurality of building units is formed;
(d) concurrently applying said adhesive between adjacent ones of said plurality of building units such that substantially waterproof joints are formed therebetween;

(e) concurrently connecting ones of said plurality of hangers to selected ones of said plurality of building units and to the underlying supporting structure such that said wall assembly is secured to the underlying supporting structure; and (f) filling said cellular structure of each of said plurality of building units with insulating material.

9. A building unit comprising:

(a) a shell having walls including a front wall, a bottom wall, a top wall, and a pair of opposing end walls;

(b) at least one alignment boss formed integrally with and extending outwardly from said top wall;

(c) at least one alignment socket formed integrally with and extending inwardly from said bottom wall; said alignment socket dimensioned to be telescopable cover said alignment boss;

(d) vertical web means for strengthening said top wall and said bottom wall;

(e) diagonal web means for strengthening junctures between said pair of opposing end walls and said top wall and said bottom wall, respectively; and (f) said side walls have greater thickness than said top wall and said bottom wall; said side wall thickness providing a seat for a waterproof joint between an end wall of a first one of said building units and a front wall of an adjacently spaced, second one of said building units at a corner of a structure being constructed from said building units.

10. A building unit comprising:

(a) a shell having walls including a front wall, a bottom wall, a top wall, and a pair of opposing end walls;

(b) at least one alignment boss formed integrally with and extending outwardly from said top wall;

(c) at least one alignment socket formed integrally with and extending inwardly from said bottom wall; said alignment socket dimensioned to be telescopable cover said alignment boss;

(d) vertical web means for strengthening said top wall and said bottom wall;

(e) diagonal web means for strengthening junctures between said pair of opposing end walls and said top wall and said bottom wall, respectively; and (f) said front wall has greater thickness than said top wall and said bottom wall; said front wall thickness providing a seat for a waterproof joint between the front wall of a first one of said building units and a front wall of an adjacently spaced, second one of said building units wherein the horizontal length of one of said first and second building units has been altered such that an end wall has been removed therefrom.

11. A building unit comprising:

(a) a shell having walls including a front wall, a bottom wall, a top wall, and a pair of opposing end walls;

(b) at least one alignment boss formed integrally with and extending outwardly from said top wall;

(c) at least one alignment socket formed integrally with and extending inwardly from said bottom wall; said alignment socket dimensioned to be telescopable cover said alignment boss;

(d) vertical web means for strengthening said top wall and said bottom wall;

(e) diagonal web means for strengthening junctures between said pair of opposing end walls and said top wall and said bottom wall, respectively; and (f) said vertical web means is perpendicular and integrally connected to said top wall, said bottom wall, and said front wall; said vertical web means extending rearwardly from said front wall about one-half the width of said top wall.

12. A building unit comprising:

(a) a shell having walls including a front wall, a bottom wall, a top wall, and a pair of opposing end walls;

(b) at least one alignment boss formed integrally with and extending outwardly from said top wall;

(c) at least one alignment socket formed integrally with and extending inwardly from said bottom wall; said alignment socket dimensioned to be telescopable cover said alignment boss;

(d) vertical web means for strengthening said top wall and said bottom wall;

(e) diagonal web means for strengthening junctures between said pair of opposing end walls and said top wall and said bottom wall, respectively; and (f) a hanger for securing said building unit to a supporting wall; said hanger having a throughbore dimensioned to encircle said alignment boss.

* * * * *